United States Patent [19]

Schweig

[11] Patent Number: 4,482,800

[45] Date of Patent: Nov. 13, 1984

[54] CIRCUIT ARRANGEMENT FOR HEATING ELEMENTS IN COOKING SURFACES OF RANGES

[75] Inventor: Dieter Schweig, Traunreut, Fed. Rep. of Germany

[73] Assignee: Bosch-Siemens Hausgeraete GmbH, Stuttgart, Fed. Rep. of Germany

[21] Appl. No.: 465,110

[22] Filed: Feb. 9, 1983

[30] Foreign Application Priority Data

Feb. 10, 1982 [DE] Fed. Rep. of Germany ..... 3204543

[51] Int. Cl.[3] ..... H05B 3/68

[52] U.S. Cl. ..... 219/446; 219/449; 219/452; 219/463; 219/466

[58] Field of Search ..... 219/218, 443, 444, 445, 219/446, 447, 449, 451, 452, 463, 464, 466, 467, 476, 480, 499, 509; 310/83, 112, 113; 318/1, 147, 148, 151

[56] References Cited

U.S. PATENT DOCUMENTS

| | | | |
|---|---|---|---|
| 2,419,083 | 4/1947 | Myers | 219/446 |
| 2,450,399 | 9/1948 | Sheidler | 219/446 X |
| 4,158,127 | 6/1979 | Husslein | 219/446 |
| 4,313,052 | 1/1982 | Fischer | 219/446 |
| 4,394,564 | 7/1983 | Dills | 219/449 |

FOREIGN PATENT DOCUMENTS 3004187 8/1980 Fed. Rep. of Germany .

*Primary Examiner*—Volodymyr Y. Mayewsky
*Attorney, Agent, or Firm*—Herbert L. Lerner; Laurence A. Greenberg

[57] ABSTRACT

Circuit arrangement for heating elements of cooking surfaces of ranges having at least two individual cooking regions with a respective control device for generating variable heat capacities, the individual cooking regions being connectible together for joint use, including heating elements operatively associated with the individual cooking regions and disposed in current paths switchable by switching elements in a manner that, in a first switching mode, the heating elements of the individual cooking regions are selectively connected to a respective heat-capacity control device and in a second switching mode, are jointly connected to one of the heat-capacity control devices, the other of the heat-capacity control devices being separated from the respective heating element associated therewith.

9 Claims, 8 Drawing Figures

FIG. 1
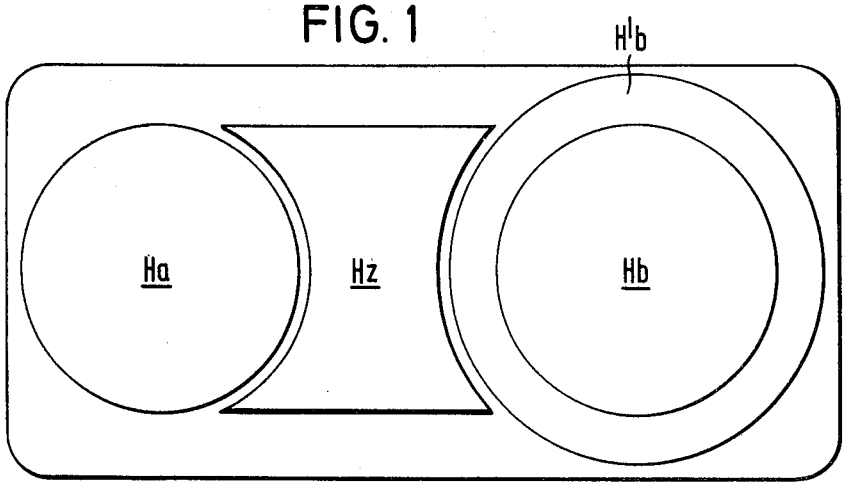
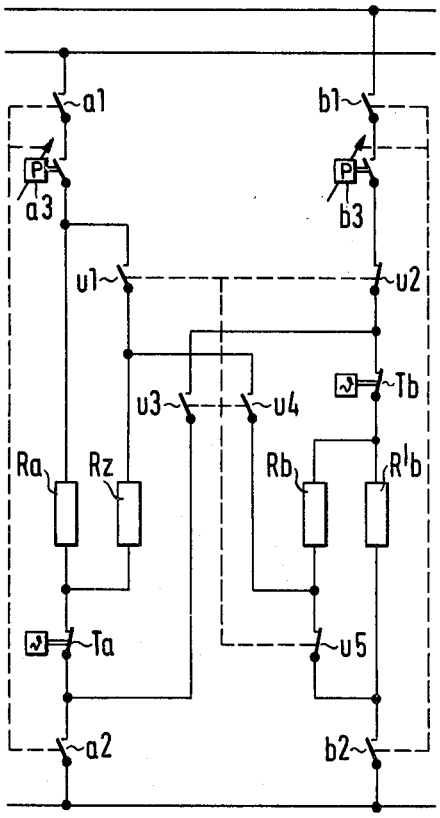
FIG. 2

FIG. 3
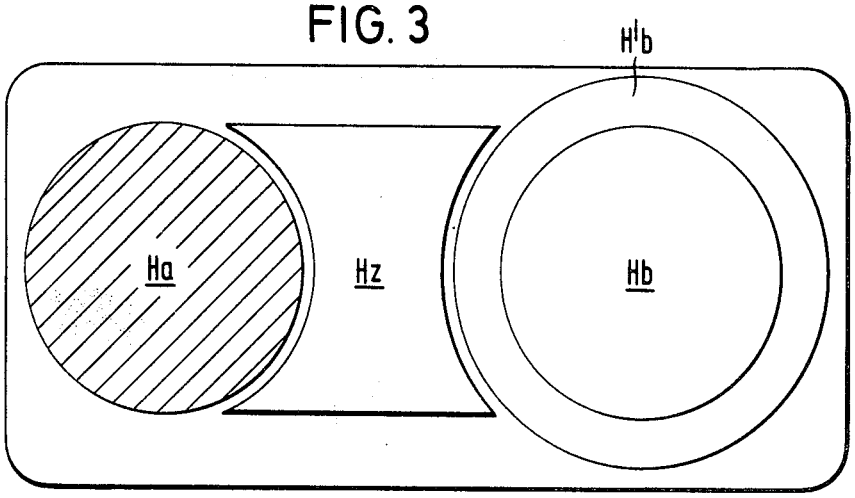
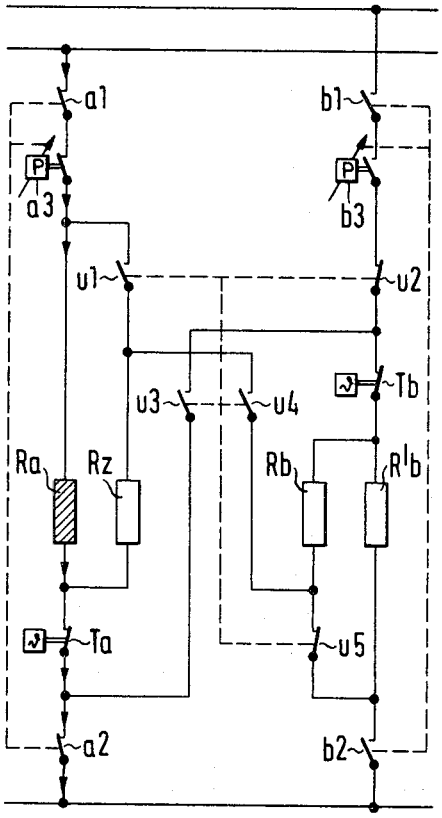
FIG. 4

FIG. 5
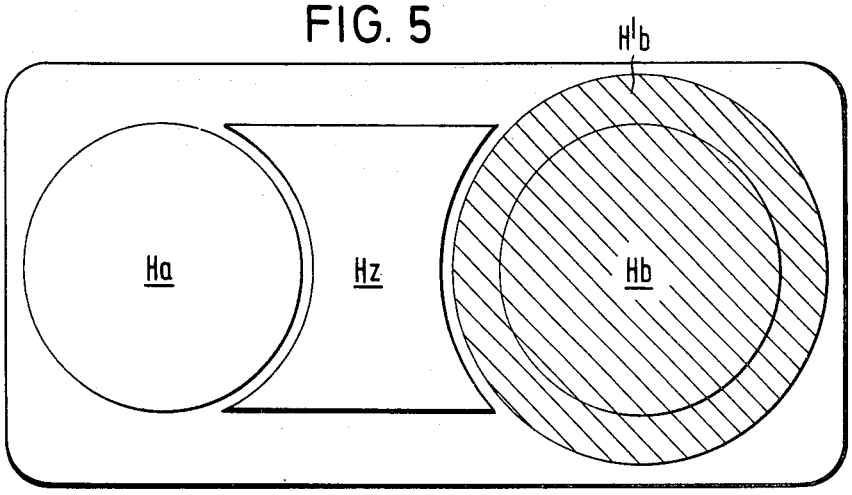
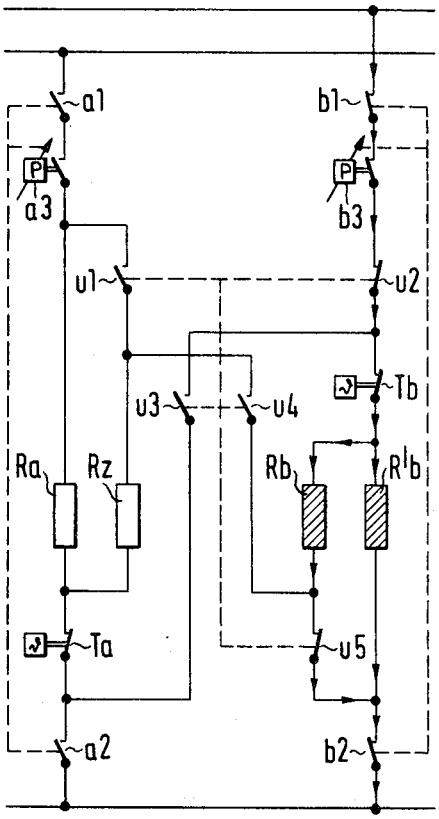
FIG. 6

FIG. 7
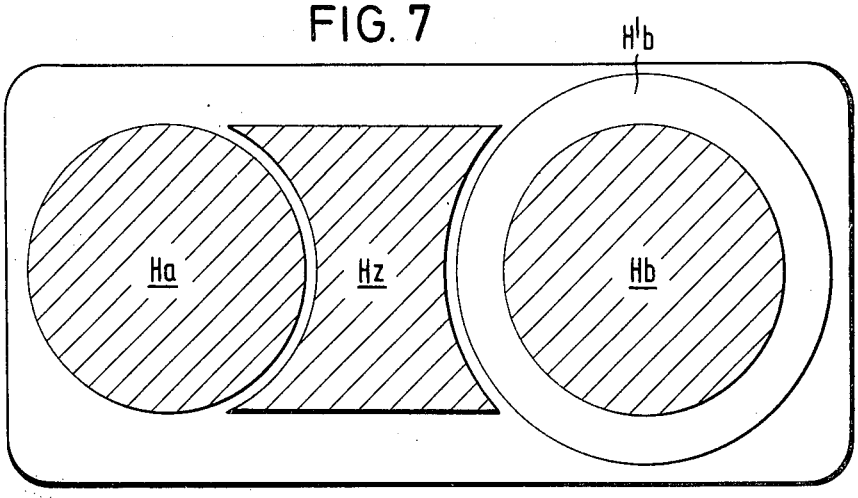
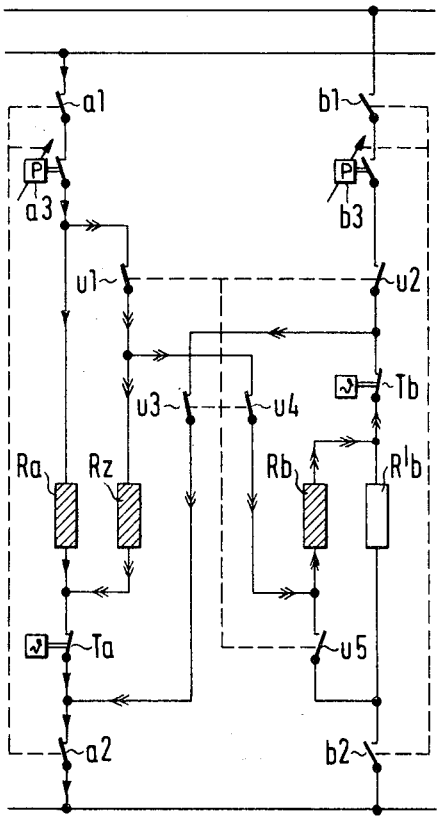
FIG. 8

CIRCUIT ARRANGEMENT FOR HEATING ELEMENTS IN COOKING SURFACES OF RANGES

The invention relates to a circuit arrangement for heating elements in cooking surfaces of ranges having at least two individual cooking regions with a respective input location for an electronic control device for generating variable heat capacities or outputs, the individual cooking regions, especially for elongated cooking pots, being useable jointly by being connected together.

In cooking surfaces for ranges, it is conventional to arrange a number of cooking regions respectively having a heating element effective, as a rule, in one heating region. For pots of different sizes, cooking regions are provided which have areas of different size.

It is also known, however, for specially shaped cooking pots, such as fish or fowl pots, for example, with elongated or oval shape, to provide the cooking regions with suitably shaped heating elements, an additional zone heater being preferably connected to a central heating region (German Published Non-Prosecuted Application DE-OS No. 30 04 181). Obviously, it is also possible to use two adjacent individual cooking regions simultaneously for a cooking pot extending over both cooking regions, the heating-power or capacity control being effected individually for both individual cooking regions. However, in this type of operation, the disadvantage is, that there is a non-heated area between the two individual cooking regions. A heretofore known solution for this problem is to provide an additional heating element between the individual cooking regions, so that an elongated cooking region is formed by the two individual cooking regions and the additional heating region disposed therebetween (German Pat. No. 26 53 389). It has also been suggested heretofore, to switch jointly the individual heating regions used, and to control them for obtaining a correspondingly dimensioned heating power output or capacity.

The invention is based upon this prior knowledge.

It is an object of the invention to provide an arrangement for controlling the heating elements when the individual cooking regions are used individually or in combination, firstly in order to permit manufacture at a lower cost, and also to assure reliable failure-free operation and use.

An arrangement satisfying these requirements for cooking plates with at least two cooking regions according to the invention has current paths assigned to the heating elements of the individual cooking regions which are connectible by switching elements in such a manner that, selectively, the heating elements of the individual cooking regions in a first switching mode are respectively connected to a heating power or heat capacity control device or, in a second switching mode, are connected jointly to one of the heating power or heat capacity control devices, while the other heating power or heat capacity control devices are separated from the respective heating element assigned thereto.

An arrangement according to these inventive features has important advantages for cooking plates from the standpoint of manufacturing technology as well as with respect to operating technique. For the application of these measures or features, it is only necessary to provide a simple switching-element group which is switchable jointly by an actuating member disposed in the control or operating field of the cooking surfaces of the range or cooking plate. Circuit-wise, only switching operations are used, likewise. Additional measures for the combination mode of operation of otherwise individually controlled heating regions are therefore not required. This has also advantageous results with respect to the operation of the cooking plate. Normally, all successively arranged individual cooking regions are operated together in the combination mode. For the person operating the range, it is sensible to operate for the individual heating-current control that control element which is assigned to the forward cooking region lying nearest to the operator. For switching to the combination operating mode, only a single input element is operated at the beginning, and the fact that the combination mode is turned on is indicated or signalled either by the position or setting of the input element, or preferably by a light-signal or a display. By the arrangement according to the invention there is also assured that the effect of the second heating-power or heat-capacity control device upon the heating elements to which it is assigned during the individual cooking mode is reliably interrupted. An operating error is thereby excluded.

A control circuit arrangement for the control of the cooking regions in cooking plates or cooking surfaces of a range, wherein at least one additional cooking region is arranged between two individual cooking regions includes in a further development of the invention, that by means of switching elements in one of the switching positions or settings thereof, this additional heating region is connected to the one heating-power or heat capacity control device. Thereby, a substantially continuous heating region is uniformly supplied with the selected, desired energy by the already existing heating-power or heat-capacity control device.

It is known and conventional practice for cooking plates or cooking surfaces of ranges to arrange individual cooking regions of different sizes, i.e. with different diameters; it may be advantageous to use the same type of heating elements generally which match the size of the smaller cooking region, and to provide an additional heating element for the larger heating regions, for example, in the form of a ring which is added to the individual heating element. However, it is disadvantageous to combine individual cooking regions of different sizes, which are individually controlled to be used individually because, in this case, different heating powers or outputs act upon the food to be cooked in different regions.

To avoid this shortcoming, the circuit arrangement according to the invention includes the advantageous provision that at least at one individual cooking region which has a central zone heating element and an additional zone heating element, both of which are controlled jointly by a heating-power or heat-capacity control device, the provision is made that at the switch position or setting of the pre-setting switching element which assigns both individual cooking regions to one of the two heating-power or heat capacity control devices, the additional zone heating element is separated from the heating power supply. In this connection, provisions are also made for this additional heating element to be not also activatible by the heating power or heat capacity control device used during the individual operation together with the central zone heating element, during the time the central zone heating element is switched to the combined heating mode.

According to a preferred embodiment, the circuit arrangement according to the invention also has switching contacts, which are arranged in series with the heating elements, and assigned to sensors in the individual cooking regions for limiting the temperature, in the mode wherein the heating elements of the individual cooking zones are jointly connected to one of the heating-power or heat-capacity control devices, the switching contacts being connected in series with the respectively assigned heating elements. Due to this preferred arrangement, no additional measures are required to prevent overheating within the scope of the invention; the temperature sensors and switches are utilized unchanged in the function thereof and, further, in the effective region thereof.

In cooking regions with heating elements without a temperature limiter of their own (such a device is often omitted at the intermediate heating elements), in switching to one of the heating power or heat capacity control devices, this region is assigned to the temperature-limiting element of the other heating element.

In accordance with another feature of the invention, to the heating element to be separated from its own heat-capacity control device and connectible to the heat-capacity control device of a further heating element, jointly switchable switching elements are connected in series between the individual current supply paths of both heating elements.

In accordance with a further feature of the invention, one of two heating zones of a cooking location is connectible to the heat-capacity control device of a further cooking location, and one of the two switching elements is connected in series with the two zone heating elements, and the other of the two switching elements is connected in series solely with the zone heating element to be connected and with the latter in parallel with the other zone heating element, and the switching element, on the one hand, is associated on the switching side to the current supply line pair of the individual current supply path associated with the heating element to be switched and, on the other hand, to the current supply line pair of the current supply pair associated with the other heating element, in a manner that at least the one current supply lines of the current supply line pairs with a common phase potential are switchable selectively, by means of the commonly switchable switching elements, with the current supply lines of other phase potentials.

In accordance with an additional feature of the invention, the switching elements are formed of a combination of a respective switch-on element and a switch-off element.

In accordance with a concomitant feature of the invention, the additional heating element disposed between the individual cooking regions with a further switching element connectible in series with the switching elements of the switchable heating element of the second individual cooking region is connected in parallel with the heating element of the first individual cooking region.

Other features which are considered characteristic for the invention are set forth in the appended claims.

Although the invention is illustrated and described herein as embodied in a circuit arrangement for heating elements in cooking surfaces of ranges, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a diagrammatic view of the cooking surface of a range having two individual cooking regions and an intermediate cooking region;

FIG. 2 is a circuit diagram for a heating energy control system, in non-operating state;

FIGS. 3 and 4 are views corresponding respectively to those of FIGS. 1 and 2, however, with a first cooking region in operating state;

FIGS. 5 and 6 are also views corresponding respectively to those of FIGS. 1 and 2, however, with a second cooking region on operating state; and FIGS. 7 and 8 are likewise views corresponding respectively to those of FIGS. 1 and 2, however, with both the first and the second cooking region as well as the heating region intermediate thereto in operating state.

Referring now to the drawing and first, particularly, to FIG. 1 thereof, there are shown, in a diagrammatic view, a first individual cooking region Ha, a second individual cooking region Hb, H'b divided by suitable design of the heating elements thereof into two zones, and an intermediate cooking region Hz disposed between the two individual cooking regions Ha and Hb, H'b.

The circuit diagram according to FIG. 2 contains switch-on and switch-off elements, heating-power control elements, temperature-limiting elements and the heating elements R which are associated with the heating region H according to FIG. 1. Elements specific to the first heating region are identified with the letter a as part of the reference character thereof, while elements for the second heating region are similarly identified, in part, with the letter b. Switches u1 to u5 are switchable only jointly and serve for switching over from the individual cooking region operation or mode to the combination operation or mode.

In FIG. 4, there is shown the switch setting which is required for operating the individual cooking region Ha. In this regard, both jointly-to-be-switched switching contacts a1 and a2 are closed, and the energy regulator a3 is switched on. Because the switch chain u is located in rest setting and the switching contact u1 is accordingly open, only the heating element Ra has current applied thereto for generating heating energy. When overheating occurs, a temperature sensing device Ta becomes operative and opens the associated switching contact so that, when overheating occurs, the current path to the heating element Ra is interrupted.

In FIG. 6, there is shown the switch setting for the operation of the second individual cooking region. In this case, the switch contacts b1 and b2 are closed and the energy regulator b3 is switched on. The switch contacts u2 and u5 are closed in the rest setting of the operationally selective switch so that both the heating element Rb as well as the heating element R'b have regulated heating current applied thereto. A temperature sensing device Tb is provided against overheating and causes an associated switch contact to open when a given maximum temperature value is exceeded, so that the supply current for the heating elements Rb and R'b is interrupted.

Should an elongated or longish heating region, as shown in FIG. 4, be made available, the switch contact combination u is to be actuated so that the switch contacts u1, u3, u4 are closed and the switch contacts u2, u5 are opened. The heating elements Rb and Rz are then connected in parallel with the heating element Ra and can therewith have regulated heating current applied via the switch contacts a1 and a2 and the energy regulator a3. Because the switch contacts u2 and u5 are opened in the switch setting of the switch-contact combination u, and as a result of the illustrated line route, the heating element R'b is not controllable in any case. Due to the switch contact u2, the current path to the respective energy regulator device is entirely interrupted, and due to the opened switch contact u5 and the corresponding line route, no current flow can occur through the heating element R'b either via the closed switch contact a2 or via the closed switch contact b2. Due to the measures involving switching technology which are under discussion, like phase potential is present at the heating element R'b, in this case, for simultaneously closed switch contacts a2 and b2.

It is obvious that the operating modes illustrated, on the one hand, in FIGS. 3 and 4 and, on the other hand, in FIGS. 5 and 6 can be performed concurrently in a conventional manner.

The foregoing is a description corresponding to German Application P No. 32 04 543.3, dated Feb. 10, 1982, the International priority of which is being claimed for the instant application, and which is hereby made part of this application. Any discrepancies between the foregoing specification and the aforementioned corresponding German application are to be resolved in favor of the latter.

I claim:

1. Electrical circuit arrangement for heating elements of cooking surfaces of ranges having at least two individual cooking regions with a respective electrical control device for generating variable heat capacities, the individual cooking regions being connectible together for joint use, comprising electrical heating elements located at the individual cooking regions and disposed on current paths switchable by switching elements in a manner that, in a first switching mode, said heating elements of the individual cooking regions are selectively connected to a respective heat-capacity control device and, in a second switching mode, are jointly connected to one of the heat-capacity control devices, the other of the heat capacity control devices being separated from the respective heating element with which it would otherwise have been connected in said first switching mode.

2. Circuit arrangement according to claim 1 with an additional heating region located intermediate the individual heating regions wherein, in one of the switching modes wherein the individual cooking regions are connected together, the additional heating region is connected by said switching elements to said one heat-capacity control device.

3. Circuit arrangement according to claim 1 with at least one individual cooking region having a central-zone heating element and with an additional zone heating element controllable jointly with the central-zone heating element by one of said heat-capacity control devices, wherein, in the switching mode wherein both individual cooking regions are connected to said one heat capacity control device, said additional zone heating element is separated from heating power supplied thereto.

4. Circuit arrangement according to claim 1, including individual switching contacts respectively disposed in series with said heating elements, sensors connected to said switching contacts and disposed at said heating elements for limiting temperature of said heating elements, said switching contacts being connected in series with said heating elements connectible in said second switching mode.

5. Circuit arrangement according to claim 1, wherein in said switching modes when given heating elements having no temperature limiting means of their own are connected to said heating power control devices, said given heating elements are connected to switching elements connectible with other heating elements for temperature limiting.

6. Circuit arrangement according to claim 3, wherein, to the heating element to be separated from its own heat-capacity control device and connectible to the heat-capacity control device of a further heating element, jointly switchable switching elements are connected in series between the individual current supply paths of both heating elements.

7. Circuit arrangement according to claim 6 wherein one of two heating zones of a cooking location is connectible to the heat-capacity control device of a further cooking location, and one of the two switching elements is connected in series with the two zone heating elements, and the other of the two switching elements is connected in series solely with the zone heating element to be connected and with the latter in parallel with the other zone heating element, and said switching element, on the one hand, being connectible in the switching side to the current supply line pair of the individual current supply path associated with the heating element to be switched and, on the other hand, to the current supply line pair associated with the other heating element, in a manner that at least the one current supply lines of the current supply pairs with a common phase potential are switchable selectively, by means of the commonly switchable switching elements, with the current supply lines of other phase potentials.

8. Circuit arrangement according to claim 6 wherein said switching elements are formed of a combination of a respective switch-on element and a switch-off element.

9. Circuit arrangement according to claim 7 wherein said additional heating element disposed between the individual cooking regions with a further switching element connectible in series with said switching elements of said switchable heating element of the second individual cooking region is connected in parallel with the heating element of the first individual cooking region.

* * * * *